United States Patent [19]

Nilsson

[11] 4,170,338

[45] Oct. 9, 1979

[54] FLOOR SHUTTERING

[75] Inventor: Sven F. Nilsson, Huddinge, Sweden

[73] Assignee: P-Form AB, Soderbarke, Sweden

[21] Appl. No.: 850,700

[22] Filed: Nov. 10, 1977

[30] Foreign Application Priority Data

Nov. 12, 1976 [SE] Sweden ..... 7612692

[51] Int. Cl.[2] ..... E04G 11/40

[52] U.S. Cl. ..... 249/31; 249/176; 249/212

[58] Field of Search ..... 249/28-32, 249/176, 212

[56] References Cited

U.S. PATENT DOCUMENTS 1,079,045 11/1913 Hammett ..... 249/29

1,553,427 9/1925 Baker ..... 249/28

2,775,019 12/1956 Bemis ..... 249/176

*Primary Examiner*—John McQuade

*Attorney, Agent, or Firm*—Haseltine, Lake & Waters

[57] ABSTRACT

Floor shuttering comprising a predetermined number of elongated forms having inverted U-shaped cross-section, said forms being mutually joined together along adjacent side edges and being arranged on inverted U-shaped support members, which are carried on beams extending perpendicular to the forms. Said support members being mutually interconnected by means of retaining elements extending at least in the space between opposite side-walls in the forms and the support members and further being carried by the beams, which are raisable and lowerable in a movable frame structure.

6 Claims, 2 Drawing Figures

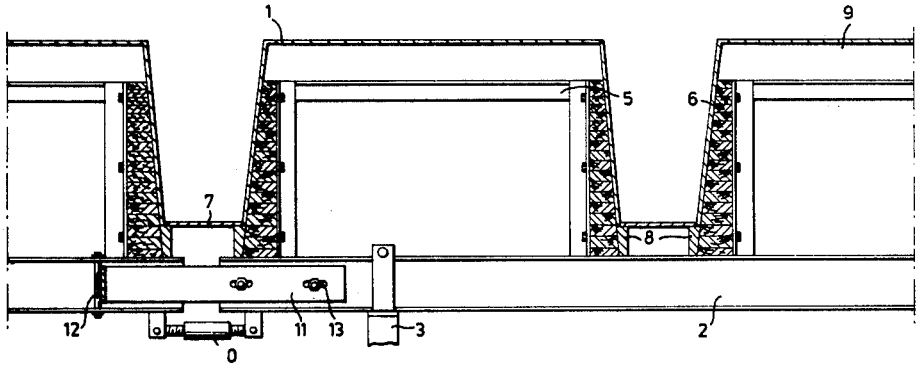

FLOOR SHUTTERING

The invention relates to a shuttering for concreting floors comprising elongated forms having inverted, substantially U-shaped cross-section and especially to a movable shuttering.

Concrete floors are known, in which the underside of the floor is waveshaped in cross-section. When concreting such floors elongated forms having inverted, substantially U-shaped cross-section are used. Such shutterings are widely used, for instance when building hospitals, stores, parking buildings, offices, schools, industrial buildings, and so on. This sort of floors are specially useful when they are supported by two opposite walls. The dimensions in the waveshaped cross-section as well as the thickness of the floor can be freely chosen, which means that permitted stresses in the concrete and in the reinformcement can be fully utilized.

When concreting floors the shuttering is subjected to large forces, which means that strong support structions for the shuttering have to be built up before concreting the floors. This is time consuming and requires much material. It is true that the material in the support structure can be reused, but in practice it is impossible to avoid material wastage. Further, the dismantling of the support structure after the concreting can be more time consuming than building it up.

One object with the invention is to eliminate these drawbacks and to obtain a movable shuttering of the above mentioned kind, which makes rapid concreting or large floors possible. This has been accomplished by means of a shuttering comprising elongated forms having inverted, substantially U-shaped cross-section in which a predetermined number of said elongated forms are arranged on support members having inverted, substantially U-shape, said support members being carried on beams extending perpendicular to the longitudinal direction of said forms and further being mutually interconnected by means of retaining elements extending in the longitudinal direction of said forms between on one hand at least two opposite side-walls in the forms and on the other hand said support members, said retaining elements stiffening the forms and being carried by said beams, whereby the beams are raisable and lowerable in a movable frame structure.

Further objects and features of the invention will be obvious in the following detailed description of an embodiment of the invention. In the drawings.

Figure 1:
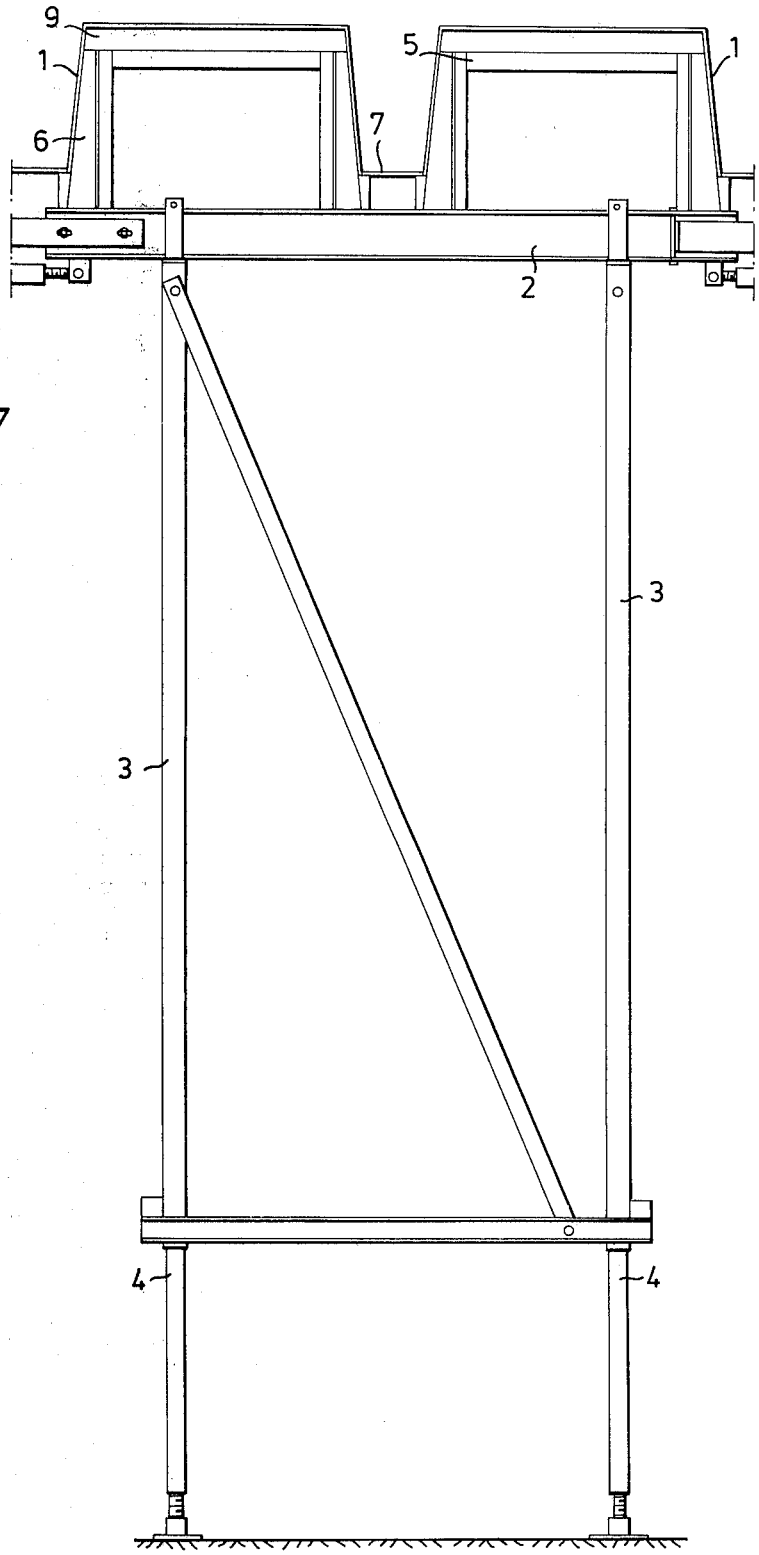
FIG. 1 shows a shuttering according to the invention.
Figure 2:
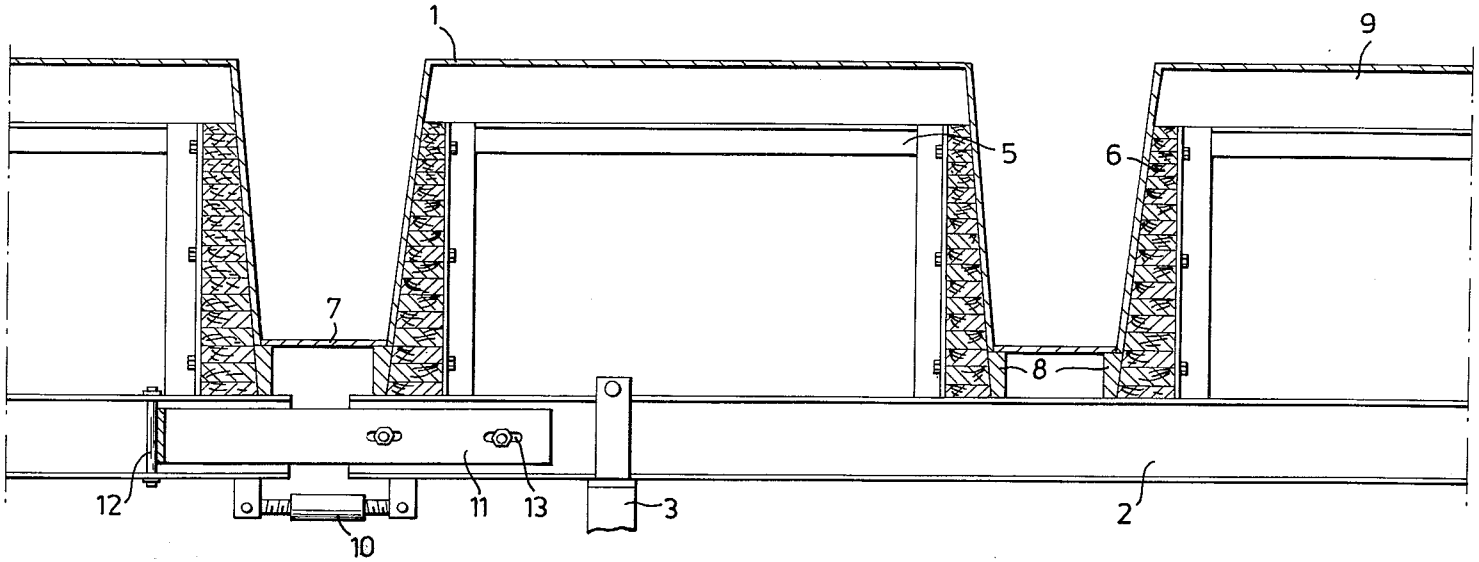
FIG. 2 shows a cross-section illustrating some details of the shuttering according to the invention.

A shuttering according to the invention comprises a number of elongated, parallel forms 1, having inverted, substantially U-shaped cross-section.

The forms 1 are supported by means of section beams 2 which are placed perpendicular to the longitudinal direction of the forms and rest on a movable frame structure 3. The frame structure 3 rest against the ground on legs 4, which are telescopally extendable. Thus, the shuttering is raisable and lowerable.

The forms 1 rest on support members 5, comprising iron beams properly welded or screwed together. Said support members 5 are mounted on the upper side of the section beams 2 and they are in the longitudinal direction of the forms 1 mutually interconnected by means of retaining elements 6, which properly are fixed at the support members 5 so that the slightly inclined side-walls of the forms 1 rest against said retaining elements 6. Preferably the retaining elements 6 are made out of laminated wood, which is relatively cheap.

The side edges of adjacent forms 1 are joined together by means of bottom plates 7, which rest on supports 8, fixed on the support member 6 and/or on the section beams 2. For further stiffening the forms 1 cross-bars 9 can be arranged at some interspaces along the longitudinal direction of the forms, said bars being supported by the retaining elements 6 and being situated closer to each other than the section beams 2 and the support members 5.

The shuttering according to the invention is preferably manufactured in sections, and in the embodiment shown in the drawings each section comprises two elongated forms with corresponding support members and frame structure. However, it is obvious that each section can comprise three or more elongated forms.

When transporting a shuttering according to the invention to an intended building site a desired number of elongated forms 1 are placed within each other, whereby all the members of the support structure can be placed in the uppermost form. On the building site the support structure is assembled whereafter the elongated forms are placed on the support members. Adjacent sections of the shuttering are interconnected, for instance by means of stretching screws 10 and guiding plates 11. These guiding plates 11 are pivoted in the section beams 2 by means of hinges 12 and can be fixed at adjacent bar sections by means of in holes 13 having screws inserted therethrough.

When concreting a part of a floor is performed the shuttering is lowered by means of telescopic legs 4 so that the shuttering can be moved for further concreting.

The shuttering according to the invention is easy to handle and permit concreting desired floor lengths.

I claim:

1. A floor shuttering comprising a number of elongated, inverted trough-shaped core forms arranged parallel to each other having their adjacent side-walls mutually spaced and supported by support means on beams extending perpendicular to the longitudinal direction of the forms, and joining means joining the lower edges of adjacent side-walls of said forms, so as to close mutual spaces between adjacent side-walls at their lower edges, said support means comprising inverted U-shaped support frame means corresponding in number to the number of forms, mounted on said beams within a respective form, and two retaining and stiffening wall members connected to each of said support frame means and extending on the inside of the side-walls of said forms for strengthening against external pressures, said beams being carried by a movable frame structure means in a vertically adjustable position.

2. A floor shuttering according to claim 1, wherein: said forms are disposed on said retaining and stiffening wall members.

3. A floor shuttering according to claim 1 wherein: the lower edges of the side-walls of adjacent forms are mutually joined together by means of bottom plates.

4. A floor shuttering according to claim 1, wherein: the shuttering is comprising a plurality of sections.

5. A floor shuttering according to claim 4, wherein: adjacent sections of said shuttering are interconnected by stretching screws and guiding plates.

6. A floor shuttering as claimed in claim 1, wherein: said support means for each form additionally include cross-studs extending perpendicular to the longitudinal direction of the form being supported on the upper edges of said retaining and stiffening wall members.

* * * * *